US005570640A

United States Patent [19]

Kroesch

[11] Patent Number: 5,570,640

[45] Date of Patent: Nov. 5, 1996

[54] YAW DAMPER FOR RAILWAY CARS

[75] Inventor: Donald F. Kroesch, Minooka, Ill.

[73] Assignee: Railway & Industrial Services, Inc., Joliet, Ill.

[21] Appl. No.: 364,353

[22] Filed: Dec. 27, 1994

[51] Int. Cl.[6] ..... B61F 5/24

[52] U.S. Cl. ..... 105/199.1; 105/199.3; 188/307

[58] Field of Search ..... 105/167, 168, 105/199.1, 199.3; 188/306, 307; 280/80

[56] References Cited

U.S. PATENT DOCUMENTS

| | | | |
|---|---|---|---|
| 1,318,052 | 10/1919 | Carter | 188/307 |
| 2,098,723 | 11/1937 | Frei | 105/168 |
| 2,153,389 | 4/1939 | Perkins | 105/199.1 |
| 2,349,610 | 5/1944 | Brunner | 105/199.2 |
| 2,352,039 | 6/1944 | Travilla, Jr. | 105/199.1 |
| 2,464,760 | 3/1949 | Dean | 105/199.1 |
| 2,705,926 | 4/1955 | Burdick | 105/199.1 |
| 3,020,857 | 2/1962 | Dean | 105/199.1 |
| 3,162,275 | 12/1964 | Grossnickle | 105/199.4 |
| 3,420,548 | 1/1969 | Wakeman | 188/306 |
| 3,865,045 | 2/1975 | Jones, Jr. | 105/199.1 |
| 4,113,111 | 9/1978 | Theurer et al. | 105/199.1 |

FOREIGN PATENT DOCUMENTS

| | | | |
|---|---|---|---|
| 2263526 | 7/1993 | United Kingdom | 188/307 |

*Primary Examiner*—S. Joseph Morano
*Attorney, Agent, or Firm*—Ernest Kettelson

[57] ABSTRACT

A yaw damper for railway cars comprises a pair of rotary hydraulic units connected to the laterally extending truck bolster of a railway truck assembly on opposite sides of its central pivot bearing member, a pair of connecting plates secured to the corresponding laterally extending car body bolster under a railway car in position on the truck assembly on opposite sides of the corresponding pivot bearing member of the car body bolster, the rotary hydraulic units on the truck bolster connected to respective ones of the connecting plates on the car body bolster by respective ones of a pair of longitudinally adjustable connecting rods. The connecting rods are connected at one end to the pivotable crank or stabilizing lever of respective ones of the hydraulic units and at the other end to connecting lugs of respective ones of the connecting plates. The hydraulic units are positioned against a forward or rearward side wall of the truck bolster in abutting relationship thereagainst to resist torque forces which would otherwise tend to rotate the housing of the rotary hydraulic unit when torque forces are applied to its pivotable crank or stabilizing lever. Such location forwardly or rearwardly of the truck bolster also enables use of a large hydraulic chamber able to provide greater torque and damping effect to control and minimize yaw of railway truck assemblies.

9 Claims, 7 Drawing Sheets

YAW DAMPER FOR RAILWAY CARS

BACKGROUND OF THE INVENTION

This invention relates to the field of devices for minimizing and absorbing the shock forces transmitted to a railway car and its cargo resulting from the railway trucks under the car pivoting slightly back and forth between the opposite rails of the railway track as the train moves down the track.

Prior art devices of this kind of which the inventor is aware include those described in the following United States patents:

Pat. No. 3,865,045 discloses a device for damping objectionable oscillations of railway trucks about their swivel axes, comprising a pair of reciprocating plungers on opposite sides of the railway car and truck assembly, biased outwardly, having one end connected to a bracket secured to respective sides of the railway car and the other end connected to respective sides of the truck assembly. When the truck assembly starts to pivot in one direction the outwardly biased plunger on that side resists pivotal movement in that direction, and the same for the plunger on the other side when the truck assembly starts to pivot in that direction.

Pat. No. 3,420,548 discloses a hydraulic control device for semi-trailer and truck combinations, and the like, to resist the tendency to jackknife. It includes a cylindrical hydraulic chamber having a rotatable vane mounted at a location substantially parallel to the axis of rotation of the trailer and tractor. The rotatable vane is connected through a lever to the trailer and applies resistance to rotation of the trailer relative to the tractor thus resisting the tendency to jackknife.

Pat. No. 3,162,275 discloses a tension compression link assembly having a reciprocating rod received in an elongated cylinder or casing in which friction brake type elements are supported to apply compressive friction resistance to reciprocating movement of the rod, one end of the cylinder and rod assembly being connected to an outer end of the railway truck bolster, the other end being connected to the railway car frame.

Pat. No. 3,020,857 discloses a friction type shock absorber comprising a cylinder and plunger having a friction type brake shoe to frictionally resist reciprocating movement within the cylinder or barrel, the cylinder assembly including a barrier or stop to limit reciprocating movement of the plunger into the barrel, one of the shock absorbers connected to an outer edge of the railway car body, the other end connected to an outer end of the truck bolster.

Pat. No. 2,705,926 discloses a first rotary vane hydraulic type shock absorber secured to one corner of a railway truck assembly and a second one secured to the diagonally opposed corner thereof, the operating levers of the rotary shock absorbers being pivotally connected to link members which are secured to adjacent portions of the railway car body, to resist forces applied in a substantially horizontal plane between the railway truck and car body such as the horizontal lateral sinusoidal oscillation of the truck assembly which the inventor in that case calls "nosing."

Pat. No. 2,464,760 discloses a railway truck stabilizing mechanism comprising an articulated link assembly connected at its upper end to the center sill 13 of the railway car body and at its lower end to a rotary type shock absorber secured to the transom 21 of the railway truck frame 5 to dampen the pitching, rolling, nosing and swaying movements of the truck relative to the car body, primarily the pitching or galloping of the truck assembly around a horizontal transverse axis, an up and down motion of the truck assembly.

Pat. No. 2,352,039 discloses a rotary type shock absorber connected to the laterally extending end transom of the frame of a railway truck assembly at an intermediate location between the adjacent oppositely disposed wheels, the operating lever or crank of the rotary shock absorber being positioned for rotation on a longitudinally extending horizontal axis whereby its outer end moves up and down in an arcuate path, a connecting link connected between the outer end of the shock absorber crank and the bottom of a longitudinal sill extending down the midline under the railway car body, such shock absorber mounted in that position resisting the up and down motion which can be set up in a railway truck assembly sometimes known as "galloping," as well as providing resistance to other abnormal movements of the truck assembly relative to the railway car body.

Pat. No. 2,349,610 discloses an oscillating damper rigidly affixed to a railway car body, its operating lever extending downward for connection at its free end to a link rod connected to the railway truck assembly or bogie at the center of its laterally extending frame midway between the wheels on each opposite side, to dampen movements of the railway truck assembly relative to the railway car body.

Pat. No. 2,153,389 discloses a railway car sway control mechanism comprising brackets secured to the sills along opposite sides of the railway car at a location forward or rearward of the truck assembly and near the end of the railway car, a guideway comprising spaced apart upper and lower walls extending between the brackets to receive the outer free end portion of a tongue assembly extending from the railway truck, a pair of rotary shock absorbers mounted either on the tongue assembly or on the sills on opposite sides of the railway car, the operating levers of such shock absorbers connected to link rods which are secured to the car body when the shock absorbers are mounted on the tongue assembly and conversely to the tongue assembly when the shock absorbers are mounted on the sills of the car body, such mechanism damping or minimizing the lateral or side sway of railway cars.

In addition, the inventor is aware of reciprocating hydraulic cylinder type damping devices, comprising elongated cylinder and plunger assemblies, in which a first one is connected at one end to the laterally extending bolster of the railway truck assembly between a first side edge and the centrally positioned pivot bearing member with the opposite end of such elongated cylinder and plunger assembly being connected to the railway car at an underneath location spaced apart longitudinally from the truck bolster, and in which a second one of such elongated cylinder and plunger assemblies is connected at one end to the truck bolster at a location between the second opposite side edge thereof and its centrally positioned pivot bearing member, this second elongated cylinder and plunger assembly having its opposite end also connected to the railway car at an underneath location spaced apart longitudinally from the truck bolster.

SUMMARY OF THE INVENTION

The yaw damper in accordance with the present invention provides an improved connection between the railway truck assembly and the railway car body. It provides a compact rotary hydraulic unit secured to the truck bolster with its hydraulic chamber positioned adjacent a laterally extending side wall thereof and downwardly from the upper surface of the truck bolster. This gives greater clearance between the truck assembly and the railway car than if the hydraulic chamber were secured on top of the upper surface of the truck bolster.

A first rotary hydraulic unit is secured to the truck bolster on one side of its central pivot bearing member about midway towards the side edge on that side, and a second rotary hydraulic unit is secured to the truck bolster on the other side of the central pivot bearing member about midway towards the side edge on that other side.

The railway car body has a laterally extending car body bolster with a centrally located pivot bearing member which seats in and engages the corresponding pivot bearing member of the truck bolster when the railway car is in position on the truck assembly.

A first connecting plate is bolted to the laterally extending car body bolster on one side of its central pivot bearing member about midway towards the side of the car body on that side. A connecting rod extends from that first connecting plate to the crank or stabilizing lever of the first rotary hydraulic unit on the corresponding side of the truck bolster of the truck assembly.

A second connecting plate is bolted to the car body bolster on the other side of its central pivot bearing member about midway towards the side of the car body on that side. A connecting rod extends from that second connecting plate to the crank or stabilizing lever of the second rotary hydraulic unit on the corresponding other side of the truck bolster of the truck assembly.

If and when the truck assembly begins to oscillate or rotate back and forth between the track rails, the rotary hydraulic units on the truck bolster resist rotation of their stabilizing levers whereby the connecting rods are able to substantially hold the truck bolster and truck assembly against rotation relative to the car body bolster and railway car, as well as to absorb any shock forces transmitted by attempts of the truck assembly to oscillate or rotate as it is rolling down the tracks.

By securing the rotary hydraulic units alongside the truck bolster and the connecting plates to the laterally aligned car body bolster in positions where they are in substantially one above the other relationship, there is greater assurance that the connecting rods between the plate on the car body and its connection to the stabilizing lever of the rotary hydraulic unit will only apply pull or push rotational pressure thereto and to the truck bolster when forces begin to rotate the truck assembly and truck bolster relative to the car body bolster.

In prior art devices wherein an elongated hydraulic cylinder for example is connected at one end to the truck bolster and to a longitudinally spaced apart location of the railway car at its other end, the plunger of the hydraulic cylinder unit can be pulled outwardly and pushed inwardly by movement of the car body relative to the truck assembly other than by rotation of the truck bolster relative to the car body bolster. If the car body sways to one side relative to the truck assembly, the distance between the connecting points to the car body and truck assembly will be increased or decreased. An elongated reciprocating hydraulic cylinder and plunger unit connected between those two points would tend to lengthen or shorten. To the extent it resists such lengthening and shortening, to that extent the elongated hydraulic cylinder and plunger unit pulls or pushes the side of the truck bolster it is connected to which thereby causes the truck bolster and truck assembly to unintentionally rotate relative to the car body bolster and railway car.

The rotary hydraulic yaw damper assembly in accordance with the present invention and its unique connection to the truck bolster enables use of a large enough hydraulic cylinder and rotatable vane to provide greater torque than prior art devices in this field. The present invention utilizes the relatively large space in front of, or behind of, the side wall of the truck bolster and downwardly from the upper surface of the truck bolster in which to position the hydraulic chamber. A unique mounting plate extension is provided to accomplish such placement of the hydraulic chamber in that space, such mounting plate extension being integrally formed with the top wall of the hydraulic chamber and extending laterally therefrom to seat over the top of the upper surface of the truck bolster.

The mounting extension plate includes a pair of bolt receiving apertures therethrough positioned to come into registration with already existing bolt receiving apertures through the upper surface of the truck bolster when the hydraulic cylinder is in place against the side wall of the truck bolster. The already existing bolt receiving apertures are the ones for securing the side roller bearing assembly to the truck bolster. The mounting plate extension is thus sandwiched between the side roller bearing assembly and the upper surface of the truck bolster when the rotary hydraulic yaw damper in accordance with this invention is secured to the truck bolster.

The hydraulic chamber in accordance with this invention is designed to reduce resistance of the operating lever and rotatable vane to rotation when the railway car travels around a curve. When travelling around a curve, the truck bolster rotates a substantial amount relative to the car body bolster and the connecting rod thereby causes the operating lever and vane of the rotary hydraulic unit to rotate farther toward one side wall or the other of the hydraulic chamber. In order to reduce the hydraulic pressure build up as the vane rotates toward one side or the other of the hydraulic chamber, the portions of the arcuate chamber wall which approach each opposite side wall are expanded into larger arcs having longer radii. The arcuate wall throughout these expanded portions adjacent each side wall become spaced apart farther from the free end of the rotatable vane thus reducing pressure against rotation throughout these regions approaching each opposite end wall of the hydraulic chamber. The truck assembly is thereby free to rotate as much as necessary when travelling through curves of the railway track.

Other advantages and improvements of the rotary hydraulic yaw damper in accordance with this invention will become apparent from the more detailed description which follows and from examining the accompanying drawings.

DESCRIPTION OF PREFERRED EMBODIMENT

Figure 1:
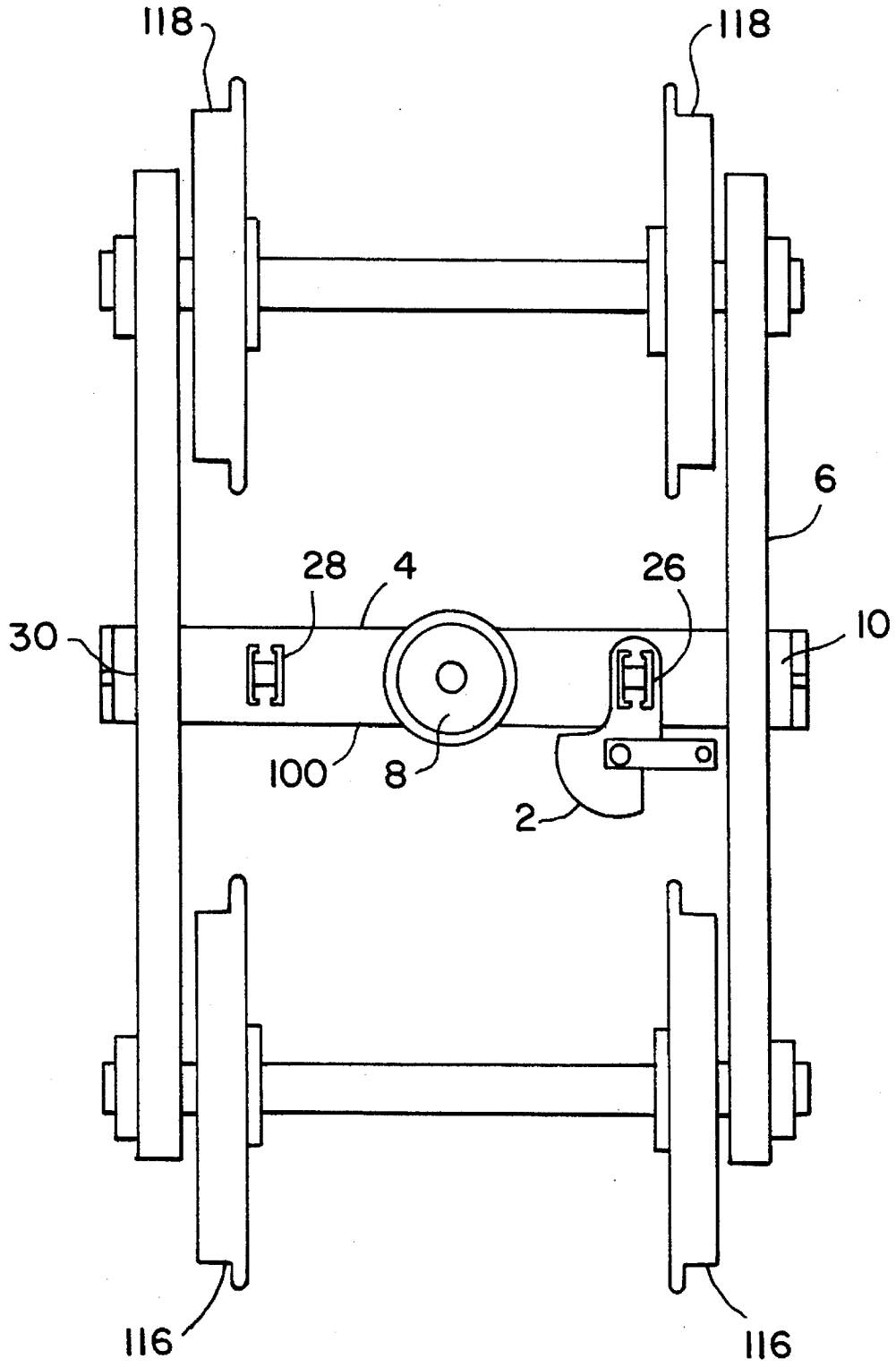
FIG. 1 is a plan view from above of a railway car truck assembly having a rotary hydraulic stabilizer in accordance with this invention mounted on the truck bolster.
Figure 2:
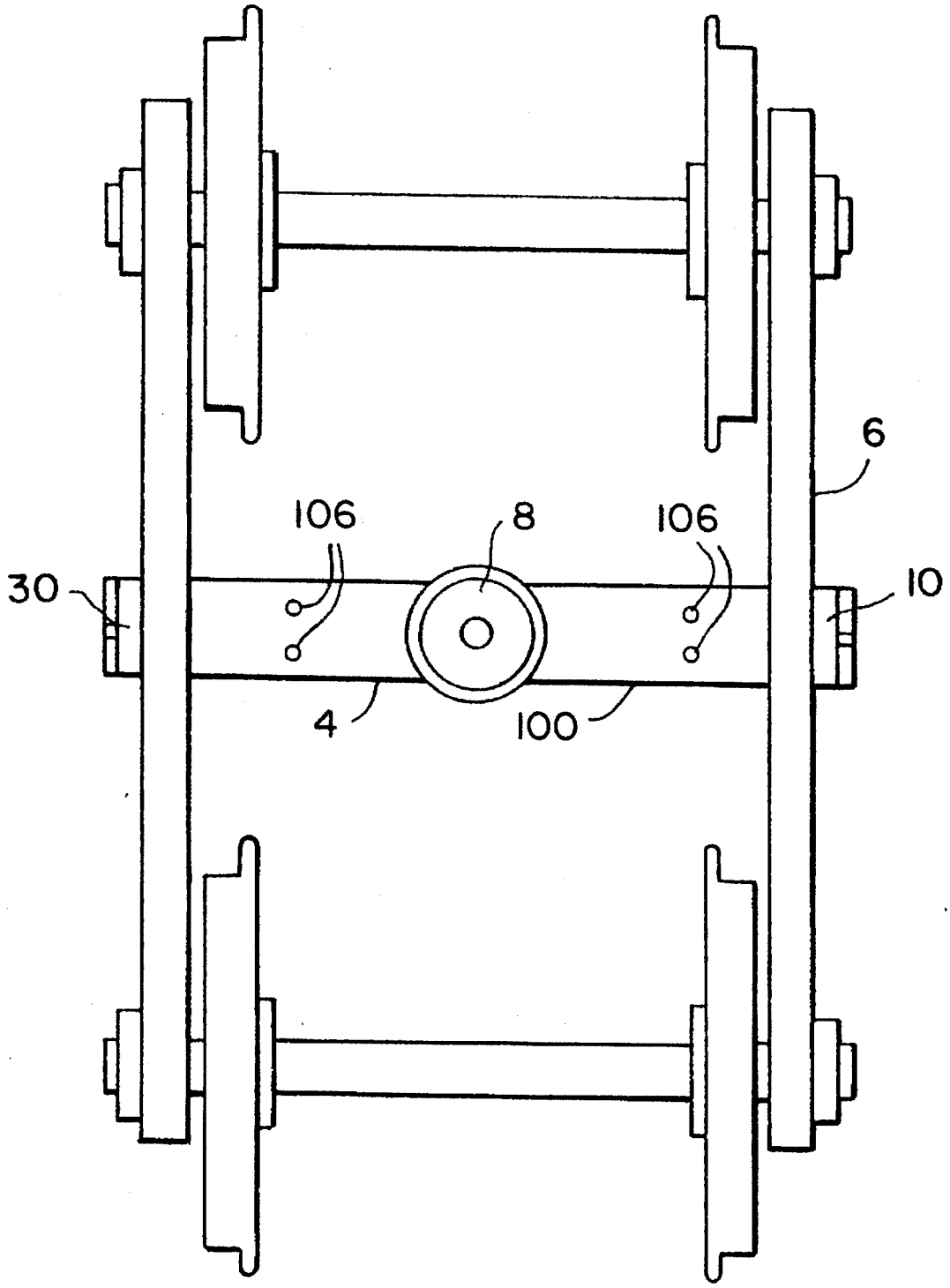
FIG. 2 is a plan view of the railway car truck assembly of FIG. 1 with the rotary hydraulic stabilizer removed to show the mounting apertures through the truck bolster.
Figure 3:
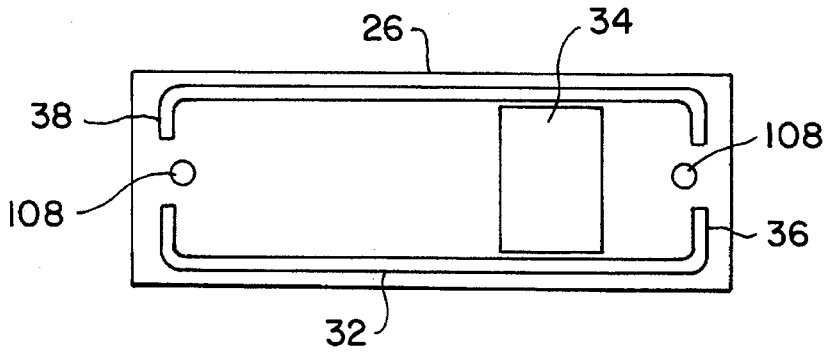
FIG. 3 is a plan view from above of a roller bearing assembly which is shown in FIG. 4 bolted to the truck bolster with the mounting plate of the rotary hydraulic stabilizer sandwiched therebetween.
Figure 4:
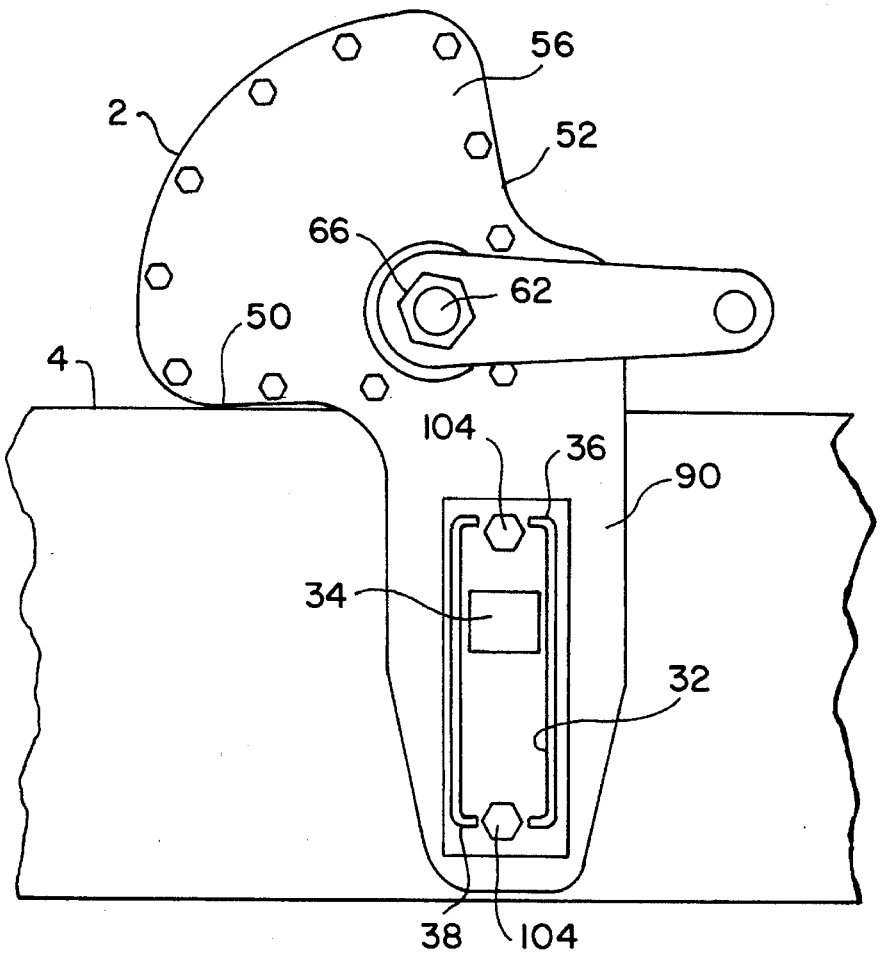
FIG. 4 is a plan view from above of the rotary hydraulic stabilizer bolted to the truck bolster sandwiched between it and the roller bearing assembly above, utilizing the same cap screws or bolts and apertures used to secure the roller bearing assembly to the truck bolster.
Figure 5:
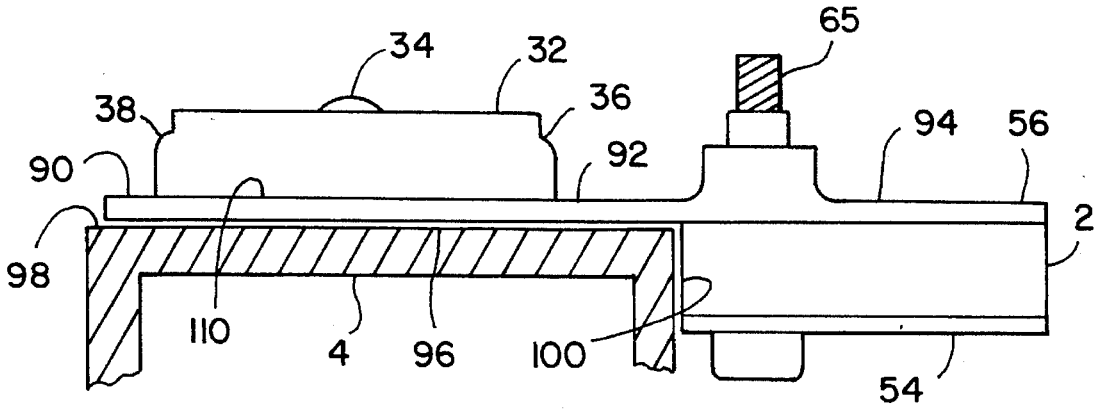
FIG. 5 is a side elevation view of the rotary hydraulic stabilizer in accordance with this invention shown mounted on the truck bolster.
Figure 6:
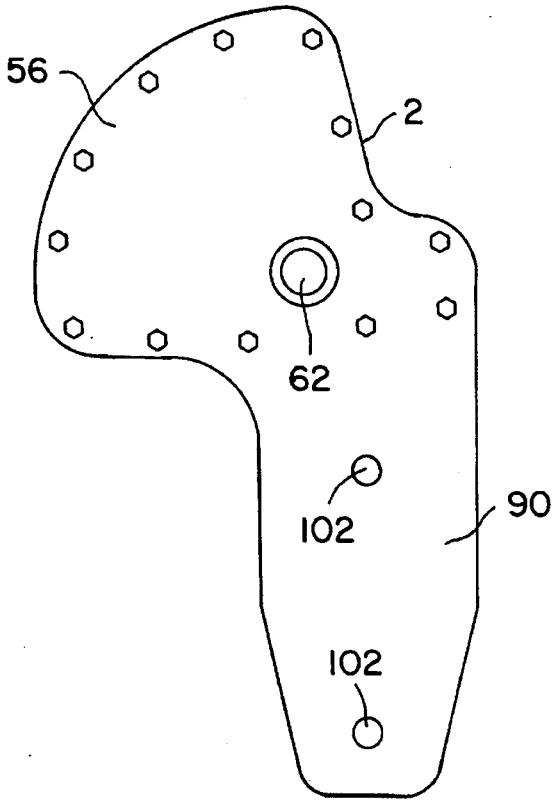
FIG. 6 is a top plan view of the rotary hydraulic stabilizer showing more clearly the mounting extension plate which is integrally formed with the top wall of the hydraulic chamber and coplanar therewith.
Figure 7:
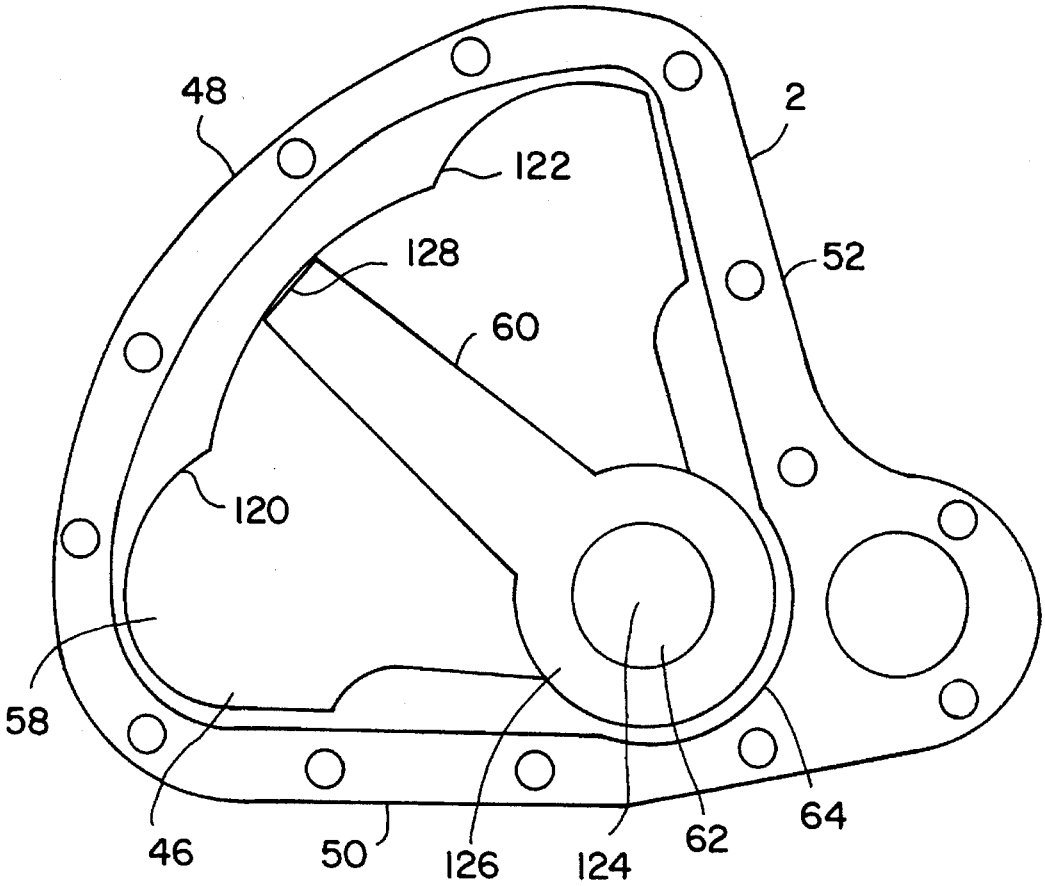
FIG. 7 is an enlarged view of the hydraulic chamber with the top wall removed.
Figure 8:
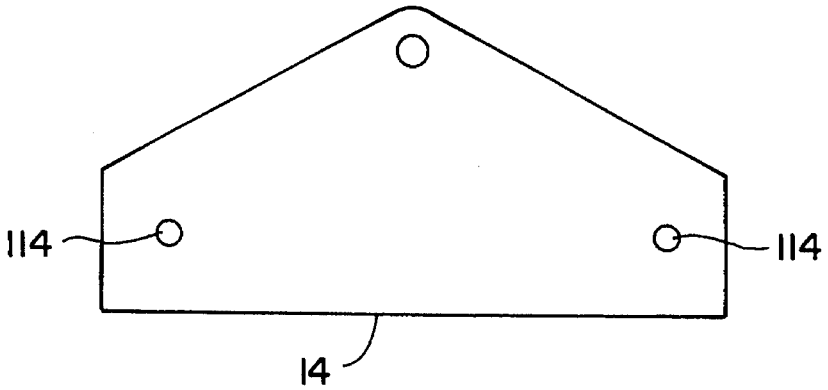
FIG. 8 is a plan view of the plate member of the car body collector assembly to which the rotary hydraulic stabilizer is connected when the plate member is bolted to the car body bolster of a railway car mounted on the truck assembly.
Figure 9:
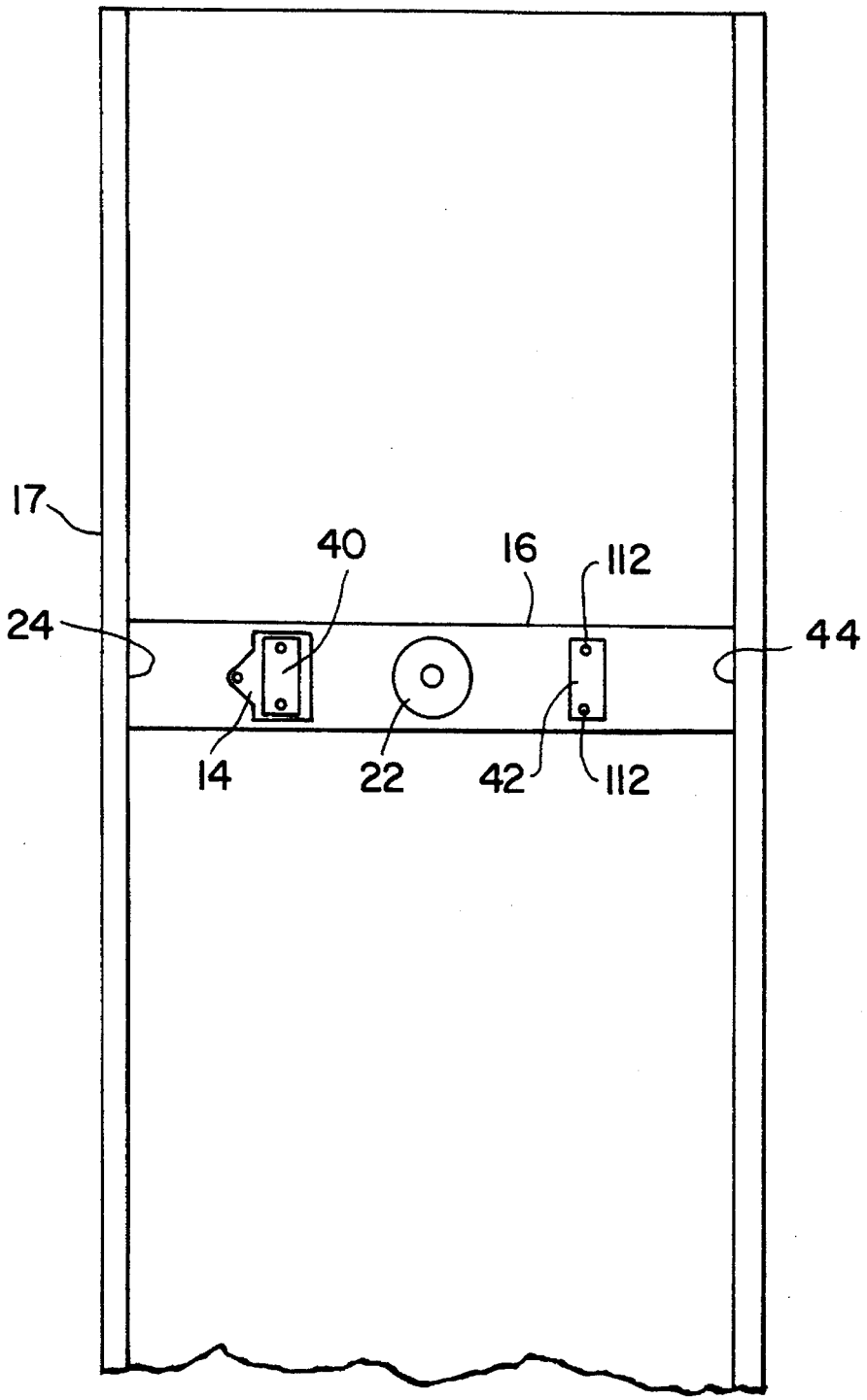
FIG. 9 is a bottom plan view of a fragment of a railway car showing one of its car body bolsters and showing the plate member of FIG. 8 bolted in place thereon.
Figure 10:
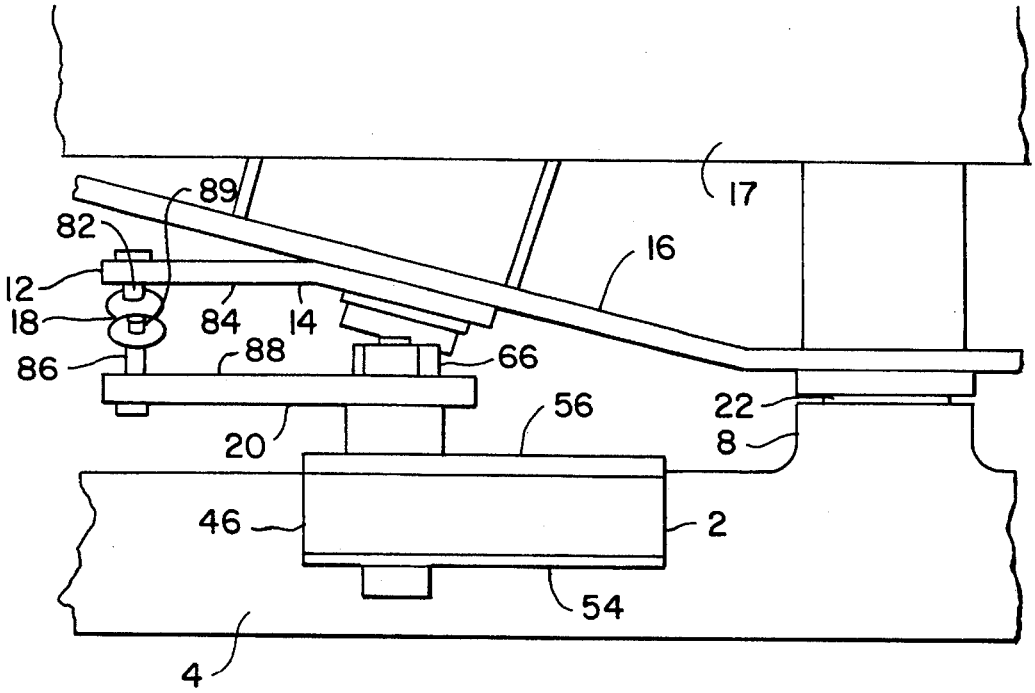
FIG. 10 is an end elevation view of a fragment of a railway car and its car body bolster in place on the truck bolster, a fragment of which is shown, to illustrate the connection of the rotary hydraulic stabilizer on the truck bolster to the car body connector assembly on the car body bolster.
Figure 11:
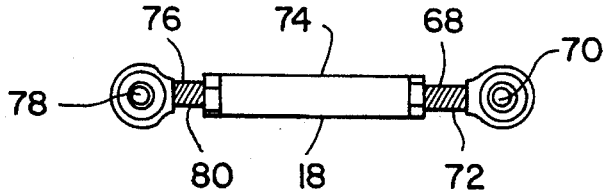
FIG. 11 is an elevation view of the adjustable connecting arm which connects the operating lever of the rotary hydraulic stabilizer to the plate of the car body connector assembly on the railway car bolster.

A rotary hydraulic yaw dampener for railway cars in accordance with this invention comprises a rotary hydraulic stabilizer 2 mounted on the laterally extending bolster 4 of a railway car truck assembly 6 between the central pivot bearing member 8 and side edge 10 of the truck bolster 4.

A car body connector assembly 12 comprises a plate member 14 which is secured to the laterally extending car body bolster 16 under the railway car 17, positioned at a location thereon for connection of its connecting arm 18 to the stabilizing lever 20 of the rotary hydraulic stabilizer 2. Such location is between the centrally located cooperative pivot bearing member 22 on the car body bolster 16 and side edge 24 of such bolster 16.

A first side roller bearing assembly 26 is mounted on the truck bolster 4 near its side edge 10 and a second side roller bearing assembly 28 is mounted on the truck bolster 4 near its opposite side edge 30, each comprising a channel member 32 and a roller bearing 34 therein to roll in a longitudinal direction from one end wall 36 to the opposite end wall 38 of the channel member 32.

The car body bolster 16 has a first cooperative wear plate 40 secured thereto near its side edge 24 positioned to engage the first roller bearing assembly 26 on the truck bolster 4 when the railway car 17 is mounted in position on the truck assembly 6. The car body bolster 16 also has a second cooperative wear plate 42 secured thereto near its opposite side edge 44 positioned to engage the second roller bearing assembly 28 on the truck bolster 4 when the railway car 17 is in place on the truck assembly 6. At such time, the cooperative pivot bearing member 22 secured to the car body bolster 16 is in abutting engagement with the central pivot bearing member 8 on the truck bolster 4.

The rotary hydraulic stabilizer 2 in accordance with this invention comprises a hydraulic chamber 46 having an arcuate peripheral wall portion 48 terminating at a first radially extending side wall portion 50 at one end and at a second radially extending side wall portion 52 at the opposite end, a bottom wall 54 and a top wall 56 bounding a sealed cavity 58 filled with hydraulic fluid. A rotary vane member 60 is mounted for limited rotation in the cavity 58 between its normal position midway between radially extending side wall portions 50 and 52 and movement against hydraulic pressure in the direction toward side wall portion 50 as well as movement in the opposite direction against hydraulic pressure toward side wall portion 52 of the hydraulic chamber 46.

The rotary vane member 60 is mounted on a rotatable shaft 62 which extends through the hydraulic chamber 46 in the corner region 64 thereof where side wall portions 50 and 52 converge. The shaft 62 extends upwardly from the bottom wall 54 of the hydraulic chamber 46 and through its top wall 56. The outwardly extending portion 65 of shaft 62 extends upwardly above the top wall 56 for connecting the stabilizing lever 20 thereto secured by a nut 66.

The connecting arm 18 comprises a first shaft 68 having a first coupling aperture 70 at its outer end and external threads 72 extending inwardly thereof from its opposite end received in one end of the internally threaded coupling sleeve 74, and a second shaft 76 having a second coupling aperture 78 at its outer end and external threads 80 extending inwardly thereof from its opposite end received in the opposite end of the internally threaded coupling sleeve 74.

The first coupling aperture 70 of the connecting arm 18 receives the lug 82 which extends from the surface 84 of the plate member 14 of the car body connector assembly 12, which faces downwardly when the railway car 17 is in place on the truck assembly 6.

The second coupling aperture 78 of the connecting arm 18 receives a lug 86 which extends from the surface 88 of the stabilizing lever 20 at its outer end, which surface and lug faces upwardly when the rotary hydraulic stabilizer 2 is mounted on the truck bolster 4. The lug 86 has a predetermined length whereby its outer or upper end 89 terminates at a vertical level that corresponds substantially with the vertical level of the connecting arm 18 of the car body connector assembly 12 secured to the car body bolster 16 when the railway car 17 is in place on the truck assembly 6.

The rotary hydraulic stabilizer 2 includes a mounting extension plate 90 integrally formed with the top wall 56, extending outwardly from and substantially normal to side wall portion 50 when the top wall 56 is secured in place on the hydraulic chamber 46. The upwardly facing surface 92 of the mounting extension plate 90 is coplanar with the upwardly facing surface 94 of the top wall 56.

The downwardly facing surface 96 of the mounting extension plate 90 is seated on the upwardly facing surface 98 of the truck bolster 4, with the side wall portion 50 of the hydraulic chamber 46 abutting up against the side wall 100 of the truck bolster 4. A pair of bolt receiving apertures 102 which are spaced apart longitudinally extend through the mounting extension plate 90 for receiving cap screws 104 therethrough for reception in threaded bolt holes 106 which are correspondingly spaced apart longitudinally and opening to the upwardly facing surface 98 of the truck bolster 4.

The side roller bearing assembly 26 also has a pair of bolt receiving apertures 108 extending through its bottom wall 110, spaced apart longitudinally the same distance as the threaded bolt holes 106 of the truck bolster 4.

In railway car truck assemblies which do not have a rotary hydraulic stabilizer 2 in accordance with this invention, the roller bearing assemblies are secured to the truck bolster 4 by placing the apertures 108 of the roller bearing assemblies on each side of the bolster in registration with the corresponding bolt holes 106 opening to the upper surface of the truck bolster 4 on each side thereof, extending the cap screws 104 therethrough and tightening down.

The rotary hydraulic stabilizer 2 in accordance with this invention is constructed to enable securing it to the truck bolster 4 by use of the same cap screws 104 and bolt holes 106. When the longitudinally spaced apart apertures 102 of the mounting extension plate 90 of the stabilizer 2 are placed in registration with bolt holes 106 in the truck bolster 4, the roller bearing assembly 26 is placed on top of the extension plate 90 with its longitudinally spaced apart apertures 108 placed in registration with extension plate apertures 102 and truck bolster bolt holes 106. The cap screws 104 are then placed through the aligned apertures and bolt holes and tightened down to secure both the rotary hydraulic stabilizer 2 and the roller bearing assembly 26 to the truck bolster 4.

The same construction is provided on the opposite side of the truck bolster 4 for securing roller bearing assembly 28 and a second rotary hydraulic stabilizer 2 to that opposite side of the truck bolster 4.

By this construction of the rotary hydraulic stabilizer 2 in accordance with this invention as described above, the straight side wall portion 50 of the hydraulic chamber 46 is held in bearing engagement against the side wall 100 of the truck bolster to resist torque pressures on the body of the stabilizer 2 when its stabilizing lever 20 is urged in one direction or the other by forces applied from its connection to the connector assembly 12 on the underside of the railway car 17.

The side walls 48, 50 and 52 of the hydraulic chamber 46 are positioned below the plane of the upwardly facing surface 98 of the truck bolster 4 by the construction and mounting means as described. The hydraulic chamber 46 is also spaced apart longitudinally from the railway car body bolster 16 when the railway car 17 is in place on the truck assembly 6 and the car body bolster 16 is in lateral alignment with the truck bolster 4, thereby providing unobstructed clearance in the space between the car and truck bolsters throughout the portions between the side bearing assemblies and the central pivot bearing members.

The car body connector assembly 12 is secured to the under side of the railway car 17 as follows. A pair of longitudinally spaced apart apertures 112 extend through the car body bolster 16 at a location between its cooperative pivot bearing member 22 and side edge 24 and which will position the car body connector assembly when bolted to the apertures 112 above the mounting plate 90 of the rotary hydraulic stabilizer bolted to the truck bolster 4 when the railway car 17 is in position on the truck assembly 6.

The plate member 14 of the connector assembly 12 has a pair of corresponding longitudinally spaced apart apertures 114 for registration with apertures 112 of the car body bolster 16, to receive securing bolts therethrough to secure the plate member 14 and connector assembly 12 to the car body bolster 16.

The same construction is provided on the opposite side of the car body bolster 16 for securing a second connector assembly to that opposite side for connection to a second rotary hydraulic stabilizer 2 on the corresponding opposite side of the truck bolster 4.

When the railway car 17 is in place on the truck assembly 6, the car body bolster 16 is substantially in line laterally with the truck bolster 4 therebelow as long as the railway car 17 and truck assembly 6 are moving on the rails in a straight line. However, the truck assembly 6 comprising a pair of wheels 116 forward of the truck bolster 4 and a pair of wheels 118 rearward of the truck bolster 4, being pivotally connected to the car body bolster 16 by the central pivot bearing member 8 on the truck bolster 4 and the cooperative central pivot bearing member 22 on the car body bolster 16, will tend to pivot slightly back and forth between the rails of the railway track on which the pairs of wheels 116 and 118 are rolling.

The forward pair of wheels 116 will pivot slightly toward the rail on one side and the rearward pair of wheels 118 slightly toward the rail on the opposite side of the track. As the flanges of the wheels adjacent the track toward which each has been pivoted come into contact with the side edge of the respective rails, such contact causes the truck assembly 6 to then pivot slightly in the opposite direction until the flanges of the adjacent wheels on the opposite side come into contact with the side edges of the respective rails on the other side. This back and forth pivoting action of the truck assembly 6 is sometimes referred to as "hunting" in the railroad industry. Such back and forth pivoting action of the truck assembly 6 jars the railway car 17 and its contents repeatedly each time the flanges of the wheels contact the side edge of the rails on one side with enough force to pivot them toward the side edges of the rails on the other side, and so on repeatedly as the railway car rolls down the track.

In operation, the rotary hydraulic stabilizer 2 in accordance with this invention damps and absorbs such jarring forces. When the forward pair of truck wheels 116 and rearward pair of truck wheels 118 are straight in line on the railway track, the connecting arm 18 of the connector assembly 12 on the railway car bolster 16 is adjusted in length to the point where its connection to the stabilizing lever 20 of the rotary hydraulic stabilizer 2 positions the stabilizing lever 20 and the rotary vane member 60 to which it is connected midway within the sealed cavity 58 of the hydraulic chamber 46 between the first side wall portion 50 and the second side wall portion 52.

As the truck assembly 6 begins to pivot the forward pair of wheels 116 toward the rail on one side and the rearward pair of wheels 118 toward the rail on the other side of the track, the truck bolster 4 to which the rotary hydraulic stabilizer 2 is secured begins to rotate out of its normally lateral alignment with the car body bolster 16 to which the connector assembly 12 and its connecting arm 18 are secured. This causes the connecting arm 18 to pull or push on the stabilizing lever 20 which in turn pivots the rotary vane member away from its normal position midway between side wall portions 50 and 52 of the hydraulic chamber 46 and toward one or the other of such side wall portions. The hydraulic fluid with which the sealed cavity 58 is filled exerts compressive pressure against the vane member 60 as it attempts to rotate toward one or the other of the side wall portions 50 and 52. The more pressure against rotation of the vane 60 and its stabilizing lever 20, the more connecting arm 18 and connector assembly 12 is able to hold the truck bolster 4 and truck assembly 6 from pivoting away from the normal lateral alignment of truck bolster 4 with the railway car bolster 16. The more the truck bolster 4 and truck assembly 6 are held against such pivoting, the lesser the shock forces which are transmitted to the railway car and its contents from whatever pivoting still occurs of the truck assembly causing its wheels to pivot toward contact with the side edge of the rails on one side and then oppositely toward contact with the side edge of the rails on the other side.

The rotary hydraulic stabilizer 2 in accordance with this invention thus damps and absorbs the repeated side to side contact forces resulting from the alternate pivoting of the truck assembly 6 between contact of its wheels with side edges of the rails first on one side and then on the other, known in the industry as "hunting."

The placement of the hydraulic chamber 46 to one side of the truck bolster 4 where it can extend in the space below the plane of the upwardly facing surface 98 of the truck bolster 4 and away from its side edge 10 makes it possible to have a large hydraulic chamber 46 to provide greater damping torque to absorb more shock forces to more effectively prevent them from being transmitted to the railway car and its cargo.

The arcuate wall portion 48 of the hydraulic chamber 46 extends from its midpoint between side wall portions 50 and 52 in a continuous arc of the same radius in both opposite directions from such midpoint until it approaches side wall portion 50 on one side and side wall portion 52 on the opposite side. A short distance inward from each of the side wall portions, at point 120 inward from side wall portion 50 and at point 122 inward from side wall portion 52 the arcuate wall portion 48 begins to extend toward each respective side wall portion in an arc of a greater radius. Thus, as the vane member 60 is rotated far enough to reach such expanded arc area of greater radius, the hydraulic pressure against the vane member 60 is lessened as it continues to rotate further toward the respective side wall portions 50 and 52. The vane member 60 normally is not rotated as far as the points at which the arc area of the wall portion 48 is expanded when performing the function of absorbing shock forces which result from "hunting" of the truck assembly 6. The vane member 60 only reaches such expanded arc regions when the railway car is going around a curve, at which time the truck assembly 6 and truck bolster 4 are rotated farther away from their normal position of substantially lateral alignment with the railway car bolster 16. It is desirable to lessen the torque of the vane member 60 and its connected stabilizing lever 20 when travelling around a curve in the railway track.

The radius of the arcuate wall portion 48 between points 120 and 122 corresponds in length to the longitudinal dimension of the vane member 60 from the center 124 of its pivot end 126 to its free end 128. The free end 128 of the vane member 60 is thus closely adjacent to the arcuate inner surface of arcuate wall portion 48 throughout its extent between points 120 and 122. The free end 128 of the vane member 60 is spaced farther apart from the inner surface of the arcuate wall portion 48 when it is pivoted into facing relationship with that portion between point 120 and side wall portion 50 and with that portion between point 122 and side wall portion 52.

I claim:

1. A yaw damper system having a truck assembly in combination with a truck bolster on said truck assembly and a car body bolster on a railway car to absorb and lessen shock forces otherwise transmitted from said truck assembly, wherein said car body bolster of said railway car extends laterally thereof, said truck bolster of said truck assembly extends laterally thereof, said truck bolster being pivotally coupled to said car body bolster, said car body bolster being above said truck bolster when said railway car is in position on said truck bolster, said truck bolster having an upwardly facing surface, a first laterally extending side wall extending downwardly from one side edge of said upwardly facing surface, a second laterally extending side wall extending downwardly from the opposite side edge of said upwardly facing surface, rotary stabilizing means to resist and absorb forces attempting to apply rotational movement in both opposite directions of rotation, said rotary stabilizing means being positioned in the space ajacent one of said first and second laterally extending side walls of said truck bolster and extending downwardly from said upwardly facing surface of said truck bolster, said rotary stabilizing means including operating means extending upwardly therefrom to operate said rotary stabilizing means, connecting means connected between said car body bolster and said operating means to operate said rotary stabilizing means when said truck assembly and its said truck bolster are rotated relative to said railway car and its said car body bolster, wherein said rotary stabilizing means includes a housing having a sealed chamber therein, compressible fluid in said sealed chamber, a vane member mounted for rotational movement in said sealed chamber and connected to said operating means, said housing having a first side wall, said first side wall of said housing being positioned adjacent said first laterally extending side wall of said truck bolster, wherein said housing includes a second side wall, said first and second side walls of said housing having first ends converging toward a corner portion of said sealed chamber, said first and second side walls of said housing having opposite second ends diverging outwardly to terminate at opposite ends respectively of an arcuate wall bounding a peripheral portion of said sealed chamber of said housing, including said arcuate wall, said housing having a bottom wall covering the bottom of said sealed chamber and a top wall covering the top of said sealed chamber, a mounting extension member of said housing extending outwardly therefrom to extend to said truck bolster when said first side wall of said housing is positioned adjacent said first laterally extending side wall of said truck bolster, said mounting extension member being secured to said truck bolster.

2. A yaw damper system as set forth in claim 1, wherein said mounting extension member comprises a flat plate having a planar upwardly facing surface and a planar downwardly facing surface, said top wall of said housing having a substantially planar upwardly facing surface, said upwardly facing surface of said top wall of said housing being substantially coplanar with said upwardly facing surface of said plate of said mounting extension member, said downwardly facing surface of said plate of said mounting extension member facing downwardly toward said upwardly facing surface of said truck bolster when said mounting extension member is secured thereto.

3. A yaw damper system as set forth in claim 2, wherein said truck assembly includes a roller bearing assembly secured to said upwardly facing surface of said laterally extending truck bolster, said roller bearing assembly comprising a channel member and a roller bearing received in said channel member, said channel member having a bottom wall, channel member aperture means through said bottom wall of said channel member to receive securing means therethrough to secure said channel member to said upwardly facing surface of said truck bolster, truck bolster aperture means through said upwardly facing surface of said truck bolster positioned for registration with said channel member aperture means when said roller bearing member is placed in position for securing to said truck bolster, mounting extension member aperture means through said plate of said mounting extension member for registration with said truck bolster aperture means and said channel member aperture means when said plate of said mounting extension member is placed in position for securing to said truck bolster, including said securing means through said channel member aperture means, through said mounting extension member aperture means and through said truck bolster aperture means to secure said roller bearing assembly and said plate of said mounting extension member of said housing of said rotary stabilizing means to said truck bolster.

4. A yaw damper system as set forth in claim 3, wherein said channel member aperture means include a pair of longitudinally spaced apart apertures through said bottom wall of said channel member of said roller bearing assembly, said mounting extension member aperture means include a pair of longitudinally spaced apart apertures through said plate of said mounting extension member, said truck bolster aperture means include a pair of longitudinally spaced apart apertures through said upwardly facing surface of said truck bolster, said plate of said mounting extension member being sandwiched between said bottom wall of said channel member of said roller bearing assembly and said upwardly facing surface of said truck bolster, said securing means including a pair of bolt members extending through respective ones of said pairs of apertures through said bottom wall of said channel member, through said plate of said mounting extension member and through said upwardly facing surface of said truck bolster.

5. A yaw damper system truck assembly in combination with a truck bolster on said truck assembly and a car body bolster on a railway car to absorb and lessen shock forces otherwise transmitted from said truck assembly, wherein said car body bolster of said railway car extends laterally thereof, said truck bolster of said truck assembly extends laterally thereof, said truck bolster being pivotally coupled to said car body bolster, said car body bolster being above said truck bolster when said railway car is in position on said truck bolster, said truck bolster having an upwardly facing surface, a first laterally extending side wall extending downwardly from one side edge of said upwardly facing surface, a second laterally extending side wall extending downwardly from the opposite side edge of said upwardly facing surface, rotary stabilizing means to resist and absorb forces attempting to apply rotational movement in both opposite directions of rotation, said rotary stabilizing means being positioned in the space adjacent one of said first and second laterally extending side walls of said truck bolster and extending downwardly from said upwardly facing surface of said truck bolster, said rotary stabilizing means including operating means extending upwardly therefrom to operate said rotary stabilizing means, connecting means connected between said car body bolster and said operating means to operate said rotary stabilizing means when said truck assembly and its said truck bolster are rotated relative to said railway car and its said car body bolster, wherein said rotary stabilizing means includes a housing having a hydraulic chamber filled with hydraulic fluid, a vane member mounted for rotational movement in said hydraulic chamber and connected to said operating means, wherein said hydraulic chamber includes a peripheral wall having an inwardly facing surface, a portion of said inwardly facing surface of said peripheral wall comprising a first arcuate portion having a first radius between a second arcuate portion on one side and a third arcuate portion on the other side wherein the radii of said second and third arcuate portions are longer than said first radius of said first arcuate portion, said vane member includes a pivot end pivotally mounted in said hydraulic chamber and a free end which terminates closely adjacent said first arcuate portion, said longitudinal dimension of said vane member from the center of its said pivot end to its said free end corresponds to the length of said first radius of said first arcuate portion of said inner surface of said peripheral wall of said hydraulic chamber whereby said free end of said vane member remains at the same closely adjacent relationship with said first arcuate portion as it is pivoted throughout the full extent of said first arcuate portion between said second and third arcuate portions, said free end of said vane member being spaced apart farther from said inwardly facing surface of said peripheral wall when it is pivoted into facing relationship with said second and third arcuate portions thereof.

6. A yaw damper system having a truck assembly in combination with a truck bolster on said truck assembly and a car body bolster on a railway car to absorb and lessen shock forces otherwise transmitted from said truck assembly, wherein said car body bolster of said railway car extends laterally thereof, said truck bolster of said truck assembly extends laterally thereof, said truck bolster being pivotally coupled to said car body bolster, said car body bolster being above said truck bolster when said railway car is in position on said truck bolster, said truck bolster having an upwardly facing surface, a first laterally extending side wall extending downwardly from one side edge of said upwardly facing surface, a second laterally extending side wall extending downwardly from the opposite side edge of said upwardly facing surface, rotary stabilizing means to resist and absorb forces attempting to apply rotational movement in both opposite directions of rotation, said rotary stabilizing means being positioned in the space adjacent one of said first and second laterally extending side walls of said truck bolster and extending downwardly from said upwardly facing surface of said truck bolster, said rotary stabilizing means including operating means extending upwardly therefrom to operate said rotary stabilizing means, connecting means connected between said car body bolster and said operating means to operate said rotary stabilizing means when said truck assembly and its said truck bolster are rotated relative to said railway car and its said car body bolster, wherein said rotary stabilizing means includes a housing having a sealed chamber therein, compressible fluid in said sealed chamber, a vane member mounted for rotational movement in said sealed chamber and connected to said operating means, said housing having a first side wall, said first side wall of said housing being positioned adjacent said first laterally extending side wall of said truck bolster, wherein said operating means to operate said rotary stabilizing means comprises an elongated stabilizing lever connected at one end to rotate with said vane member in said sealed chamber of said housing, said stabilizing lever having an opposite free end, a first connecting member extending upwardly from said stabilizing lever at the region of its said free end, said connecting means comprises a plate member secured to said car body bolster, a second connecting member extending downwardly from said plate member of said connecting means, a connecting rod having a first connecting end for connection to said first connecting member of said stabilizing lever and having a second connecting end for connection to said second connecting member of said plate member of said connecting means.

7. A yaw damper system as set forth in claim 6, wherein said connecting rod includes longitudinal adjusting means to lengthen and shorten its longitudinal dimension.

8. A yaw damper system as set forth in claim 7, wherein said longitudinal adjusting means of said connecting rod comprises a first rod member extending from said first connecting end to a first free end having first external threads thereon from said first free end extending toward said first connecting end, a second rod member extending from said second connecting end to a second free end having second external threads thereon from said second free end extending toward said second connecting end, and an elongated sleeve member having internal threads open at a first end thereof to receive said first free end and engage said first external threads of said first rod member and open at a second opposite end to receive said second free end and engage said second external threads of said second rod member, said sleeve member being rotatable in one direction of rotation to lengthen said connecting rod and in the opposite direction of rotation to shorten said connecting rod.

9. A yaw damper system as set forth in claim 6, wherein said first connecting member extending upwardly from said stabilizing lever at the region of its said free end comprises an elongated shank having a shank free end which terminates at substantially the same vertical level as that of the said second connecting member which extends downwardly from the said plate member secured to said car body bolster, when said railway car is in place on said truck assembly.

* * * * *